United States Patent [19]

Prunier

[11] 4,148,160

[45] * Apr. 10, 1979

[54] LENS SURFACING TOOL AND TOOL HOLDER

[75] Inventor: Louis J. Prunier, Oxford, Mass.

[73] Assignee: American Optical Corporation, Southbridge, Mass.

[ * ] Notice: The portion of the term of this patent subsequent to Apr. 25, 1995, has been disclaimed.

[21] Appl. No.: 857,492

[22] Filed: Dec. 5, 1977

[51] Int. Cl.[2] ..... B24B 41/00

[52] U.S. Cl. ..... 51/168; 51/209 R; 51/216 LP; 74/813 R

[58] Field of Search ..... 51/168, 209 R, 358, 51/216 LP, 217 L; 74/813 R; 403/107

[56] References Cited

U.S. PATENT DOCUMENTS

| | | | |
|---|---|---|---|
| 1,404,828 | 1/1922 | Baum | 403/107 |
| 3,346,904 | 10/1967 | Armstrong | 51/358 |
| 3,823,516 | 7/1974 | Christian | 51/358 |
| 3,827,192 | 8/1974 | Ferrand | 51/216 LP |
| 3,846,912 | 11/1974 | Newbould | 74/527 |
| 4,085,553 | 4/1978 | Prunier | 51/216 LP |

*Primary Examiner*—Harold D. Whitehead

*Attorney, Agent, or Firm*—Jeremiah J. Duggan; Howard R. Berkenstock, Jr.; Alan H. Spencer

[57] ABSTRACT

A self-aligning and centering tool and tool holder system for lens surfacing apparatus. The tool and holder are provided with readily manually assembled and disassembled interlocking faces for precise automatic rotational alignment and centering or decentering of the tool without affect by wear from the abrading action of surfacing.

4 Claims, 5 Drawing Figures

LENS SURFACING TOOL AND TOOL HOLDER

LENS SURFACING TOOL AND TOOL HOLDER

1. Field of the Invention

Ophthalmic lens surfacing apparatus with particular reference to improvements in surfacing tool and tool adaptor system.

2. Discussion of the Prior Art

Blocked ophthalmic lenses having semi-finished surfaces requiring final precision grinding and polishing are traditionally pressed against preformed tools (laps) and oscillated thereover while a grinding or polishing slurry is applied to the lens-tool interface.

In toric lens surfacing where the right-angular relationships of cylinder and spherical curvatures must be preserved, the surfacing tool is prevented from rotating upon the tool holder and, as it is well known, lens harnessing means maintains proper cylinder orientation during the oscillation. U.S. Pat. No. 3,916,547 is exemplary. In preventing rotation of the surfacing tool upon its holder with the customary key and key slot, however, there is the serious drawback of tool and adaptor wear causing axial misalignment of the tool relative to the lens surface being abraded and vice versa.

Surfacing tools and their holders are subject to considerable wear from the abrading action of surfacing. Relative rotational motion between tool and holder, however slight in new tooling, increases rapidly with tool use in the environement of a grinding slurry. Inclusions of grinding abrasives between the key and key slot cause rapid wear thereof and tool loosening and misalignment.

There being the necessity to operate lens surfacing tools in abrasive environments, the present invention has a principal objective of providing improvements in manually assembled lens surfacing tools and holders which render the accuracy of relative centering, decentering and rotational alignment insensitive to wear from the abrading action of surfacing.

Another object is to accomplish the foregoing without sacrifice of optimum ease and convenience of manual assembly and disassembly of tool and holder for desired tool interchange; and still another object is to afford the opportunity to decenter the tool as desired or needed to suit particular requirements of lens surfacing.

Other objects and advantages of the invention will become apparent from the following description.

SUMMARY OF THE INVENTION

The aforesaid objects and corollaries thereof are accomplished by providing a multiplicity of mating pyramidal protrusions on the lens surfacing tool and its holder. These pyramidal surfaces may be in the form of large knurlings extending across all or portions of the joined, or to be joined, faces of the tool and holder. Fixing the tool against rotational misalignment on its holder and in desired centered or decentered relationship therewith is accomplished by simple manual placement of one against the other.

Details of the invention will become more readily apparent from the following description when taken in conjunction with the accompanying drawings:

IN THE DRAWINGS

DESCRIPTION OF THE PREFERRED EMBODIMENTS

Figure 1:
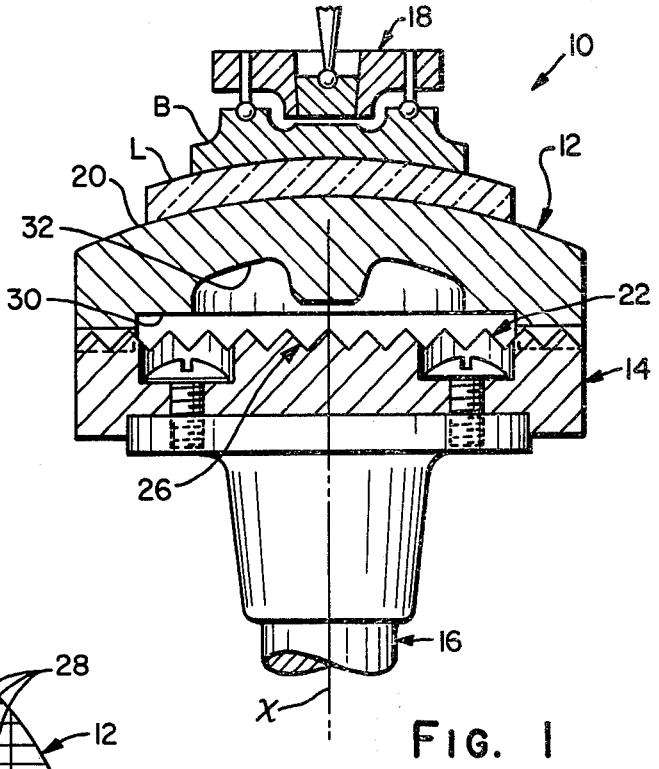
FIG. 1 is a fragmentary partially cross-sectioned illustration of lens surfacing apparatus embodying the invention.

The lens surfacing apparatus 10 of FIG. 1 comprises surfacing tool (lap) 12, holder 14 for supporting tool 12 upon spindle 16 and lens harnessing means 18 which is adapted to be oscillated in conventional fashion for moving lens L across surface 20 of tool 12. Lens L is fastened to block B which, in turn, is coupled to harnessing means 18 for maintaining proper relative rotational orientation of the lens and tool.

To the extent that apparatus 10 has been thus far described, those interested in greater detail may refer to U.S. Pat. No. 3,916,547.

As mentioned hereinabove, the present invention overcomes previous problems of wear from the abrading action of surfacing in the environment of abrasive slurries. To this end, the usual key and key slot connection between tool and tool holder is obviated. Instead, there are provided uniquely designed interfitting tool and tool holder connecting faces which are functionally insensitive to wear, i.e. the secureness of interfitting and accuracy of relative axial and rotational tool and holder alignment are uneffected by wear due to inclusions of loose abrasives.

Figure 4:
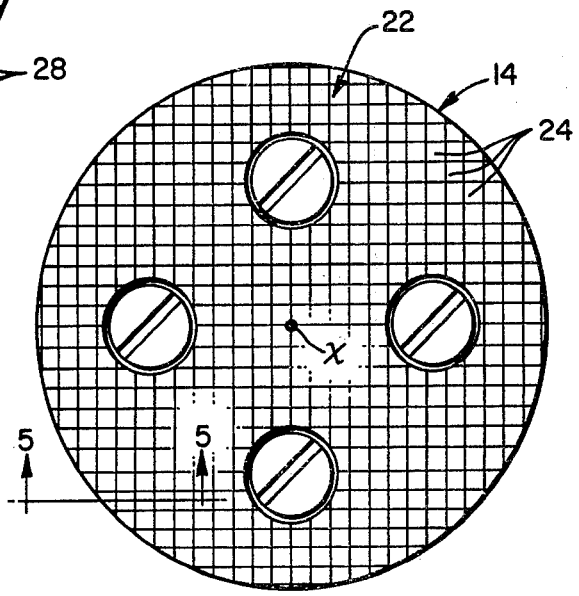
Figure 5:
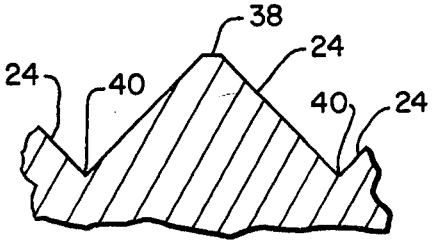
FIG. 5 is a greatly enlarged fragmentary cross-sectional view taken approximately along line 5—5 of FIG. 4.

Tool holder 14 (FIGS. 1,2 and 4) having tool supporting face 22 is provided with a uniformly patterned multiplicity of juxtapositioned pyramidal protrusions 24, one of which is illustrated in greatly enlarged cross-section in FIG. 5. As it will become apparent hereinafter, it is preferable to locate the centermost of the multiplicity of protrusions 24 precisely at the center, i.e. on vertical axis x FIG. 1, of tool holder 14. Axis x is illustrated by a dot in the center of FIG. 4.

Figure 3:
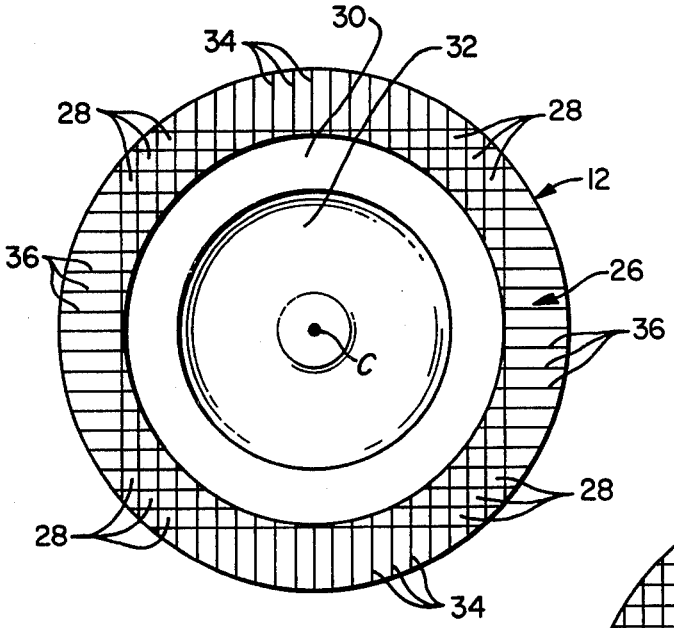
FIGS. 3 and 4 are plan views of mating faces of tool and holder components of the FIG. 1 embodiment of surfacing apparatus.

In conjunction with tool supporting face 22 of holder 14, the annular mounting face 26 of tool 12 is provided with matching pyramidal protrusions 28 which are adapted to mate with protrusions 24 upon manual placement of tool 12 against holder 14. It is pointed out that the pyramidal protrusions 28 are so relatively geometrically arranged that they are concentric with center c (FIG. 3) of tool 14 and automatically render tool 12 centered on holder 14 when edges of the tool and holder are aligned. It should be understood that recesses 30 and 32 in tool 12 may be dispensed with should it be desired to extend the illustrated annular mounting face 26 of tool 12 continuously thereacross. Since, however, this is not necessary, the illustrated annular face 26 is presently preferred. It may, nevertheless, be of greater width than illustrated, e.g. by occupying a portion or all of recess 30 and/or extended over a portion of recess 32 as well.

Figure 2:
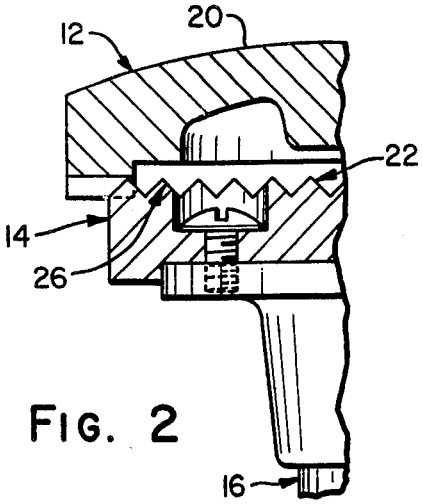
FIG. 2 is a fragmentary view of the apparatus of FIG. 1 illustrating a tool decentering feature of the invention.

In addition to the provision for automatic tool 12 centering by interfitting faces 22 and 26 as illustrated in FIG. 1, the tool may be decentered in increments of the width of one pyramidal protrusion 24 or 28 as illustrated in FIG. 2.

In either the case of centering or decentering of tool 12 upon holder 14 the outermost portions of the four right-angularly related guadrants of annular mounting face 26 of tool 14 are provided with ridges 34 and 36. Ridges 34 extend right-angularly to ridges 36 and vice versa. These ridges are continuations of corresponding ideas of pyramidal protrusions 28 and are thus adapted to mate with pyramidal protrusions 24 of holder 14 and prevent longitudinal slippage of tool 12 in any lateral direction relative to holder 14. It should be understood that ridges similar to 34 and 36 (FIG. 3 may be provided upon supporting face 22 of holder 14 if desired, i.e. as extensions of corresponding sides of pyramidal protrusion 24. By such means, ridges 34 and 36 may be eliminated from mounting face 26 of tool 12 so that pyramidal protrusions 28 can be carried from edge-to-edge of face 26.

It is contemplated that pyramidal protrusions 24, 28 and ridges 34, 36 be formed on their respective faces 22, 26 by coarse knurling of these faces. Additionally, ends 38 (FIG. 5) of all pyramidal protrusions 24, 28 and grooves 34, 36 are flattened substantially as illustrated. Thus, any wear upon pyramidal protrusions 24, 28 and/or grooves 34, 36 tending to cause their narrowing and/or shortening will merely, in turn, cause deeper fitting of tool face 22 into mounting face 26. The wear being so compensated for renders the accuracy of centering and relative rotational alignment of tool 12 and holder 14 unaffected, i.e. the system of tool 12 and holder 14 is functionally insensitive to wear from the abrading action of surfacing.

Those skilled in the art will readily appreciate that there are various other forms and adaptations of the invention which may be made to suit particular requirements.

For example, protrusions 24, 28 and/or ridges 34, 36 may be in the form of spaces between recesses formed on one or both of faces 22, 26 of tool 12 and holder 14. Furthermore, the recesses and/or protrusions may be other than pyramidal, i.e. they may be conical or frustums of cones or pyramids or in forms such as grooves and ridges extending radially from points adjacent the centers of faces 22, 26.

Accordingly, the foregoing illustrations are not to be interpreted as restrictive of the invention beyond that necessitated by the following claims.

I claim:

1. In a tool and tool holder system for lens surfacing apparatus wherein the tool has a mounting face and the holder has a tool supporting face adapted to manually releasably receive the tool mounting face, the improvement comprising:

a first multiplicity of juxtapositioned pyramidal protrusions extending over at least a portion of said mounting face of said tool;

a second multiplicity of juxtapositioned pyramidal protrusions extending over at least a portion of said supporting face of said tool holder;

said first and second protrusions on said portions of said mounting and supporting faces being of corresponding shapes and geometrical patterning for mating in interfitted relationships with each other when said faces of said tool and holder are manually brought together; and means for preventing lateral slippage between said tool mounting face and tool supporting face when said protrusions are mated.

2. A tool and tool holder system according to claim 1 wherein said pyramidal protrusions are four-sided and arranged in right-angularly aligned rows.

3. A tool holder system according to claim 2 wherein said means for preventing lateral slippage comprises extensions of said aligned rows of pyramidal protrusions, said extensions being in the form of continuous ridges corresponding in cross-sectional size, shape and directional orientation to said pyramidal protrusions of respectively aligned rows thereof.

4. A tool and tool holder system according to claim 3 wherein said first and second multiplicities of protrusions and said continuous ridges are knurlings.

* * * * *